US006337525B1

(12) United States Patent
Bock et al.

(10) Patent No.: US 6,337,525 B1
(45) Date of Patent: Jan. 8, 2002

(54) BEARING FOR A SPINNING ROTOR

(75) Inventors: Erich Bock, Wettstetten; Eberhard Grimm, Ingolstadt; Eugen Hini, Kösching; Edmund Schuller, Ingolstadt, all of (DE)

(73) Assignee: Rieter Ingolstadt Spinnereimaschinenbau AG (DE)

( * ) Notice: Subject to any disclaimer, the term of this patent is extended or adjusted under 35 U.S.C. 154(b) by 0 days.

(21) Appl. No.: 09/512,507

(22) Filed: Feb. 24, 2000

(30) Foreign Application Priority Data

Mar. 19, 1999 (DE) ..... 199 12 400

(51) Int. Cl.[7] ..... H02K 5/16; D01H 4/00

(52) U.S. Cl. ..... 310/90; 310/96; 57/406; 57/404; 384/549

(58) Field of Search ..... 310/90, 96, 99; 57/400, 406, 407, 404, 263, 264; 384/548, 549, 563, 565

(56) References Cited

U.S. PATENT DOCUMENTS 4,706,450 A * 11/1987 Feuchter et al. ..... 57/88
4,713,932 A * 12/1987 Zott ..... 57/406
4,763,469 A * 8/1988 Stahlecker et al. ..... 57/407
4,892,422 A * 1/1990 Stahlecker ..... 384/549
5,509,262 A * 4/1996 Stahlecker ..... 57/264

* cited by examiner

*Primary Examiner*—Elvin Enad
*Assistant Examiner*—Thanh Lam
(74) *Attorney, Agent, or Firm*—Dority & Manning, P.A.

(57) ABSTRACT

The present invention relates to a bearing for an open-end spinning rotor. The latter is driven at its rotor shaft by means of a tangential belt in a predetermined direction and is supported in a nip which is formed by at least two bearing disks capable of being driven by the rotor shaft. A bearing disk (at least one) leads in relation to the drive direction of the tangential belt rotating into the nip, and another bearing disk (at least one) trails in relation to the drive direction of the tangential belt rotating out of the nip. The axis of the bearing disk (at least one) rotating into the nip is at a specified distance from the plane which goes through the rotor shafts of the spinning rotors of several adjoining open-end spinning devices. This distance is being smaller than the distance between the axis of the bearing disk (at least one) rotating out of the nip and the rotor shaft plane. A plane going through the axes of the bearing disks forms an acute angle between 5° and 15° with the plane going through the axes of the spinning rotors.

10 Claims, 1 Drawing Sheet

BEARING FOR A SPINNING ROTOR

BACKGROUND OF THE INVENTION

The present invention relates to a bearing for a textile machine spinning rotor having a rotor shaft driven by a tangential belt.

In conventional open-end spinning devices the spinning rotors of the individual spining stations are normally supported in the nip of one pair of bearing disks as shown in German Patent 33 46 843 A1, or of two pairs of bearing disks, and are driven by means of a tangential belt which extends over a plurality of spinning stations adjoining each other (German patent 37 30 705 A1). It has been found that irregular oscillations or tension fluctuations occur in the tangential belt and that these are transmitted to the rotor shaft in such manner that the rotor shaft is pushed with varying force into the nip constituted by the bearing disks. Due to the varying tension of the tangential belts, the rotor shaft intermittently comes loose from the circumferential surfaces of the bearing disks forming the nip, and are then again pressed back by the tangential belt on the circumferential surfaces of the bearing disks. As a result of this the bearing disks and the rotor shaft are subjected to increased wear. In order to achieve an axial thrust on the spinning rotor, the axes of the bearing disks are placed in most spinning rotor bearings at only a very slight angle to each other, so that the axes of the bearing disks are not strictly on one and the same plane. This slight geometric deviation shall however not be taken into consideration hereinafter since it is of no consequence for the present invention.

OBJECTS AND SUMMARY OF THE INVENTION

It is therefore a principal object of the present invention to reduce the possibility of movement of the spinning rotor in the nip to such an extent that no increased mechanical stress, in particular impact stress, is incurred by the interacting parts of the bearing, in particular of the bearing disks and the rotor shaft, in order to extend the life of these parts. Additional objects and advantages of the invention will be set forth in part in the following description or may be obvious from the description, or may be learned through practice of the invention.

The above-mentioned object is attained through having the axis of a bearing disk rotating into the nip formed by two bearing disks at a specified distance from a plane which passes through the rotor shafts of the spinning rotors of adjoining open-end spinning devices, where the specified distance is less than the distance between the axis of the other disk rotating out of the nip and the plane. The inclination of the plane in which the axes of the bearing disks are located relative to the plane which runs through the axes of the spinning rotors of adjoining spinning stations causes the nip or its central axis not to be at a right angle to the plane going through the axes of the spinning rotors but, as seen in the running direction of the tangential belt, is at an acute angle to these axes.

The inclination of the plane means that the circumferential surfaces of the bearing disk which leads the tangential belt, i.e. which is located after the rotor shaft as seen in the running direction of the tangential belt presents a steeper nip flank to the rotor shaft for an otherwise identical bearing disk diameter. This acts in opposition to a rising tendency of the rotor shaft on the circumferential surface of this bearing disk which rotates into the nip. Even though the tangential belt imparts a motion component to the rotor shaft which is opposite to the rotational direction of this bearing disk which rotates into the nip, no danger exists that the rotor shaft may leave the position in which it is in contact with the bearing disk(s) rotating into the nip as well as with the bearing disk(s) rotating out of the nip, so that the running of the spinning rotor is very quiet. This has a positive effect not only on the circumferential surfaces of the bearing disks of the rotor shaft but also causes an evening-out of the yarn produced in the spinning rotor.

An embodiment of the invention can further counteract tension fluctuations in the tangential belts driving the rotor shafts, and thereby to further reduce the danger that the rotor shafts may run erratically in their nips. The axes of the bearing disks may be supported in a bearing support capable of swiveling at its one end that is subjected to the pressure of an elastic element pressing it in the direction of the tangential belt.

It has proven to be advantageous, for bearing disks of normally used diameters, if the plane going through the axes of the bearings disks forms a specified angle between 5° to 15° with the plane going through the axes of the spinning rotors of adjoining spinning stations.

The invention produces quiet running of the spinning rotor since it reduces the possibility for the rotor shaft to move radially in the nip. This fact also leads to a reduction of mechanical stress to the bearing disks and the rotor shaft and thereby to an extension of the life of the interacting rotating parts of the bearing. The quiet rotor rotation obtained by means of the device according to the invention furthermore results in an evening-out of the yarn produced in the spinning rotor.

An example of an embodiment of the device according to the invention is explained in further detail below through drawings.

DETAILED DESCRIPTION

Reference will now be made in detail to the preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
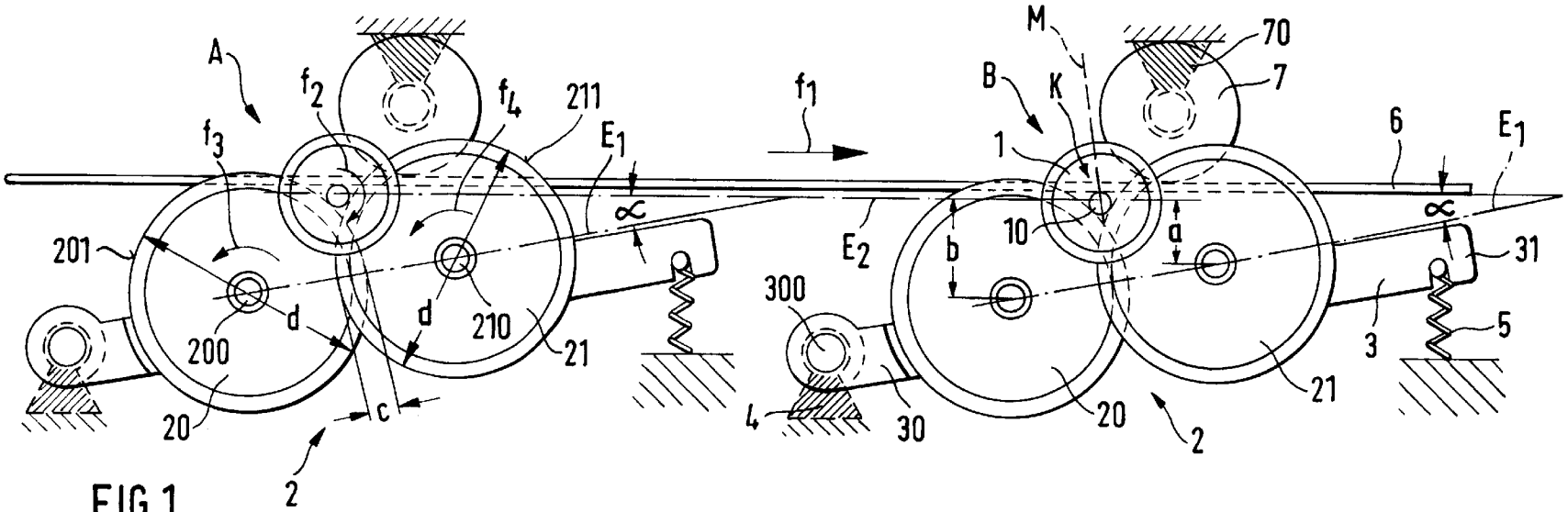
FIG. 1 schematically shows a front view of the bearings of two adjoining open-end spinning stations.

FIG. 1 shows two adjoining spinning stations A and B. In practice however, usually more than just two adjoining spinning stations A and B are provided as a rule, these being in alignment with each other and placed along one side of an open-end spinning machine. These spinning stations A, B etc. are identical in construction, and for this reason the description below is limited to a description of the elements required to understand the invention on the example of one of these spinning stations A, B, etc.

A spinning rotor 1 which is driven at a high rotational speed during the spinning process is located at each spinning station A or B. The spinning rotor 1 has a rotor shaft 10 by means of which it is supported in a nip K of a bearing 2 which is formed by two bearing disks 20 and 21, of which bearing 2 has one pair or two pairs of the disks. Each of these supporting disks 20 and 21 is supported by means of an axle 200 or 210 in bearings which are not shown and which are supported by a bearing support 3. The latter is pivotably mounted by one end 30 by means of a swivel axle 300 in a bearing 4. In the shown embodiment the free end 31 of the bearing support 3 is subjected to pressure of an elastic element 5, as shown here as a compression spring, which presses the bearing support 3 in the direction of the rotor shaft 10 and thereby of the tangential belt 6. The free end 31 can furthermore be connected to an attenuating element which is able to attenuate oscillations of the bearing support 3.

The rotor shafts 10 of the spinning rotors 1 of adjoining spinning stations A, B, etc. are located with their axes in a common plane $E_2$. A tangential belt 6 is applied to the rotor shafts 10 of the spinning rotors 1 of adjoining spinning stations A, B etc. This tangential belt is driven in the indicated direction (arrow $f_1$) and is used to drive jointly the spinning rotors 1 of the adjoining spinning stations A, B, etc. This tangential belt 6 extends essentially parallel to plane $E_2$.

On the side of tangential belt 6 away from the bearing 2 is a belt pushing roller 7 for each spinning station A, B, etc. which is supported by means of a fixed bearing 70 and, together with the elastically supported bearing 2, keeps the tangential belt in contact with the rotor shaft 10.

The tangential belt 6 driven in the direction of arrow $f_1$ is applied to the rotor shaft 10 of a spinning rotor 1 and causes the spinning rotor to rotate in the direction of arrow $f_2$. The two bearing disks 20 and 21 receive their rotational impetus from the rotor shaft 10. In this process, the bearing disk 21 which is leading relative to the running direction of tangential belt 6 (arrow $f_1$) is rotated by the rotor shaft 10 into the nip K (see arrow $f_4$), while the bearing disk 20 which is trailing relative to the running direction of the tangential belt 6 is rotated out of the nip K (see arrow $f_3$). The transmission of rotation from the rotor shaft 10 to the bearing disks 20 and 21 depends on the rotor shaft 10 being held securely in the nip K and is thereby also being pressed against the circumferential surfaces 201 and 211 of the two bearing disks 20 and 21. The elastic action of the bearing support 3 by the elastic element 5 serves that purpose.

As can clearly been seen from the drawing in FIG. 1, the distance a between the axis 210 of the bearing disk 21 and the plane $E_2$ which passes through the axes of the spinning rotors 1 of adjoining spinning stations A, B etc. is shorter than the distance b between the axis 200 of the bearing disk 20 and the plane $E_2$. If a plane $E_1$ is laid through the axes 200 and 210 of the bearing disks 20 and 21 of any spinning station A, B etc., the two planes $E_1$ and $E_2$ form an acute angle $\alpha$ between them. The acute angle $\alpha$ opens between the two planes $E_1$ and $E_2$ in a direction opposite to the running direction of the tangential belt 6 designated by an arrow $f_1$. As a result, the bearing disk 21 which is leading relative to the running direction of the tangential belt 6 (see arrow $f_1$) presents a steeper circumferential surface 211 to the rotor shaft 10 than would be the case if the planes $E_1$ and $E_2$ were to extend parallel to each other, as is explained in further detail below through FIG. 2.

Figure 2:
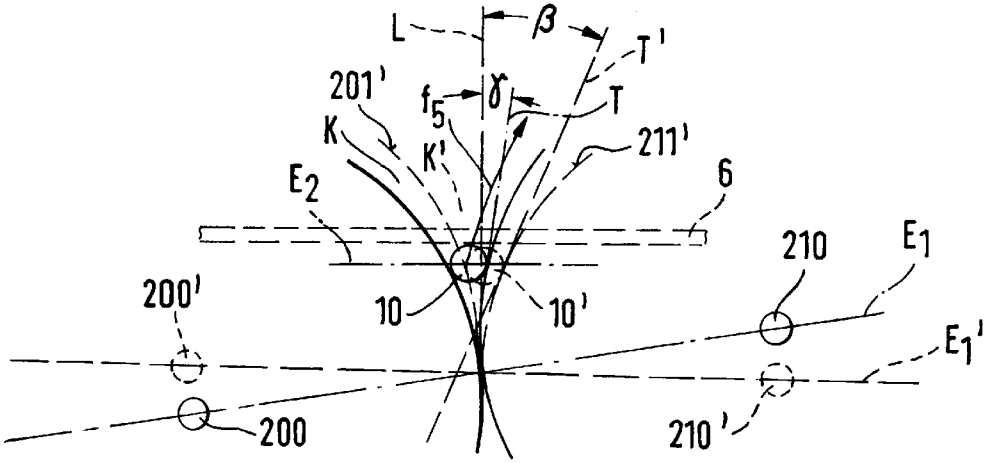
FIG. 2 schematically shows by means of solid lines the rotor shaft as well as the nip between the two bearing disks of the bearing shown in FIG. 1 in inclined position by comparison with a conventionally designed bearing disk bearing indicated by broken lines.

The previous conventional arrangement of the bearing 2 is first described through the broken-line representation in FIG. 2 (compare with FIG. 1), whereby the individual elements are referenced in addition by an apostrophe to differentiate them from the bearing 2 which is inclined at an angle $\alpha$ to the plane $E_2$.

The bearing 2 in its conventional arrangement is indicated in FIG. 2 merely by the positions of axes 200' and 210' of the two bearing disks. The plane $E_1'$ going through these axes 200' and 210' extends in this conventional arrangement of the bearing 2 at a parallel to the plane $E_2$ which goes through the axes of the rotor shafts 10' of adjoining spinning stations A, B etc. In this way, the perpendicular L, which is centered relative to nip K' and is traced to plane $E_1'$ is identical to the center line of nip K'. This position results in the two circumferential surfaces 201' and 211' of the two bearing disks which delimit the nip K' having the same relative wide inclination relative to the plane $E_1'$. This inclination is characterized by the common tangent T' between the rotor shaft 10' and the circumferential surface 211' of the bearing disk supported by axle 210' on the one hand and by the center line of the nip K' constituted by the perpendicular L on the other hand. This tangent T' forms a relatively wide angle $\beta$ with the perpendicular L.

The fact that the angle $\beta$ is relatively wide in the conventional arrangement of bearing 2 means that the tangent T' is inclined at a relatively steep angle in relation to plane $E_2$ in the running direction (arrow $f_1$) of the tangential belt 6. This arrangement furthermore means that the circumferential surface 211' of the bearing disk which is leading relative to the running direction (see arrow $f_1$) of the tangential belt 6 has also a relatively important directional component in the direction of the arrow $f_1$). Thus the danger is great that the rotor shaft 10' may climb up somewhat on the circumferential surface 211' of the leading bearing disk in the direction of arrow $f_5$ due to tension fluctuations in the tangential belt 6, even though this bearing disk rotates into the nip K' in the direction of arrow $f_4$ and therefore in the direction opposite to arrow $f_5$. Although the tangential belt 6 allows this climbing of the rotor shaft 10' on the circumferential surface 211' of the leading bearing disk for only a short time in every instance and only for a short distance before the rotor shaft 10' is pushed back by the tangential belt 6 on the bottom of the nip K', it is sufficient to result in erratic running of the spinning rotor 1. This erratic running of the spinning rotor 1 affects on the one hand the yarn being spun in the spinning rotor 1. On the other hand, this erratic running shortens the life of the spinning rotor and of the circumferential surfaces 201' and 211' of the two bearing disks which are made of a wear material. These disks must then be replaced and/or must be provided with a new coating.

In addition to the conventional positioning discussed above, FIG. 2 also shows the position of the bearing 2 as shown in FIG. 1, whereby the bearing 2 itself is not shown but can be assumed from the indicated position of the axes 200 and 210 of the bearing disks 20 and 21. The elements of the bearing 2 placed in an inclined position are represented by solid lines and are not referenced with an apostrophe.

With an inclined positioning of the bearing 2 (see angle $\alpha$ in FIG. 1), the common tangent between the rotor shaft 10 and the circumferential surface 211 of the bearing disk 21 is very steep relative to the plane $E_2$, and as a result the angle $\gamma$ is very acute between the tangent T and the perpendicular L. The movement of the tangential belt 6 which is transmitted to the rotor shaft 10, in addition to the motion component directed parallel to arrow $f_1$ against the circumferential surface 211 of the bearing disk 21, has only a relatively minor motion component in the direction of arrow $f_5$. Therefore, the retention force exerted by the bearing disk 21 rotating into the nip K upon the rotor shaft 10 is sufficient to retain the rotor shaft 10 in the nip K. In this manner, the rotor shaft 10 is prevented from climbing up on the circumferential surface 211 of the bearing disk 21 when brief tension fluctuations occur.

This non-parallel placement of the planes $E_1$ and $E_2$ (see angle $\alpha$ in FIG. 1) due to the inclined positioning of the bearing 2, results in a quieter running of the spinning rotor 1 than the conventional placement of the two planes $E_1'$ and $E_2$ which are parallel to each other, as is shown by broken lines in FIG. 2.

It has been shown that a value between 5° and 15°, preferably in the order of 10°, should as a rule be selected for the angle $\alpha$ to ensure that the tangent T forms an angle $\gamma$ of the desired size between itself and the perpendicular L in order to ensure thereby the desired quiet running of the rotor. The size of the angle $\alpha$ depends here on various factors, as shall be described below. The angle $\alpha$ must also be selected as a function of the driven speed of the tangential belt 6 and of the rotational speed of the rotor shaft 10.

The device described above can be modified in many ways within the framework of the present invention, for example, by replacing individual characteristics by equivalents or through other combinations of the characteristics of the invention. Thus for example, a comparison between FIGS. 1 and 2 shows already that the bearing disks 20 and 21 of a pair of supporting disks may be placed in a common plane and may then be almost tangent to each other (FIG. 2). Alternatively, it is also possible to provide for the bearing disks 20 and 21 to be placed in parallel planes and overlap each other slightly (FIG. 1). In this case however, the angle $\gamma$ will be somewhat flatter. In order to still achieve optimal conditions for the retention of the rotor shaft 10 in the nip K, it suffices to adapt the angle $\alpha$ between the planes $E_1$ and $E_2$ in the area c of the overlap, so that essentially the same conditions may be achieved as in the embodiment shown by a solid line in FIG. 2. In this case, the angle $\alpha$ must be wider when the overlap is greater (a larger area c) than with less overlap.

Only one pair of bearing disks 20 and 21 had been mentioned previously, e.g. in DE 33 46 843 A1. These bearing disks, according to FIG. 2, are in a common plane and may be tangent to each other, or may be located in two parallel planes as in FIG. 1, so that the two bearing disks 20 and 21 may overlap each other over a certain area c. Alternatively, it is possible to provide for two such pairs of bearing disks which also can be placed in pairs either in a common plane or in parallel planes. The two bearing disks 21 of the bearing disk pairs (as seen in the direction parallel to the axes 200, 210 . . . ) may include between them the two bearing disks 20 of bearing disks pairs (or may be surrounded by them). It is, however, possible for the bearing disks 20 and 21 of a first pair of bearing disks to be followed by bearing disks placed in the same sequence and belonging to a second pair of bearing disks, as seen in the direction parallel to axes 200, 210. These bearing disks of a second pair of bearing disks (not shown) are then mounted on a bearing support. In order to avoid the two pairs of bearing disks assuming unwanted different inclinations (angle $\alpha$) relative to plane $E_1$, and to simplify the adjustment of the bearing disks 20 and 21 of the two pairs of bearing disks (not shown) relative to the rotor shaft 10, it is advisable to mount the two pairs of bearing disks on a common bearing support 3.

An additional possibility to influence the angle $\gamma$ is provided by selecting the angle $\alpha$ as a function of the diameter d of the bearing disks 20 and 21 when the diameter d of the two bearing disks 20 and 21 and of a possible additional pair of bearing disks 20 and 21 is the same. Although it suffices to merely select a greater diameter for the bearing disk 21 than the diameter of the bearing disk 20 (not shown), this selection is not desirable because of disadvantages in providing and maintaining bearing disks with two different diameters from the point of view of purchasing as well as of storage space. Therefore an identical diameter d is advantageously selected for the bearing disk 21 that rotates into the nip K as well as for the bearing disk 20 that rotates out of the nip K. If this diameter d of the two bearing disks 20 and 21 is relatively small, a relatively high value is selected for the angle $\alpha$, while a smaller angle $\alpha$ can be selected if the diameter d of the two bearing disks 20 and 21 is relatively large.

Additional elements may be used. For example, a second tangential belt may be provided for selective temporary driving of the spinning rotor 1 at a second speed which may be different from that of the shown tangential belt 6. Also, couplings may be used to bring one or the other tangential belt 6 into engagement with the rotor shaft 10 or to disengage it from the same. These elements are not shown, however, for the sake of clarity of the drawing, since they have no influence on the discussed principle of inclined position of the bearing 2.

The elastic element (5) shown in FIG. 1 can be another element other than a compression spring. For example, a hydraulic or pneumatic piston or similar device. Furthermore, this type of elastic support of the bearing 2 for the compensation of tension fluctuations in the tangential belt 6 may also be used independently of a suitable placement of the bearing 2 relative to the plane $E_2$. On the other hand, it is not absolutely necessary for the bearing support 3 to be mounted so as to be capable of swiveling. Instead, the bearing support 3 can also be mounted rigidly, and instead of it, the belt pushing roller 7 can be subjected to elastic pressure.

What is claimed is:

1. A rotor bearing arrangement for a spinning rotor of a spinning device in an open-end spinning machine, wherein said spinning machine includes at least two adjacently disposed said spinning devices with said respective rotors having rotor shafts disposed in a common plane and driven by a common tangential belt, said bearing arrangement comprising:

at least two bearing disks configured to support and be driven by said rotor shaft, said bearing disks having a respective axis of rotation and defining a nip in which said rotor shaft rests;

one of said bearing disks being disposed in a leading position relative to a direction of travel of said tangential belt and rotatable in a circumferential direction into said nip;

said other bearing disk disposed in a trailing position relative to a direction of travel of said tangential belt and rotatable in a circumferential direction out of said nip; and wherein a vertical distance between said axis of said leading position bearing disk and said common plane of said rotor shafts is less than a vertical distance between said axis of said trailing position bearing disk and said common plane of said rotor shafts.

2. The bearing arrangement as in claim 1, wherein said bearing disks have substantially the same diameter.

3. The bearing arrangement as in claim 1, wherein said bearing disks comprise axles aligned with said respective axis of rotation, and further comprising a bearing support disposed to support said axles for rotation of said bearing disks, said bearing support pivotally mounted at an end thereof adjacent said trailing position bearing disk, and further comprising an elastic element connected to an opposite end of said bearing support adjacent said leading position bearing disk, said elastic element applying a force to press said bearing support towards said tangential belt.

4. The bearing arrangement as in claim 3, wherein said elastic element is a spring.

5. The bearing arrangement as in claim 1, wherein a bearing disk plane through said axes of said bearing disks forms an angle between about 5° and about lb 15° with said common plane of said rotor shafts.

6. The bearing arrangement as in claim 5, wherein said bearing disks are disposed in offset parallel planes such that said nip is formed at an overlapping portion of said bearing disks.

7. The bearing arrangement as in claim 5, wherein said bearing disks are disposed in a common plane such that said nip is formed at the closest position of the circumferences of said bearing disks.

8. The bearing arrangement of claim 5, wherein said angle is a function of the diameter of said bearing disks such that as the diameter of the bearing disks increases, said angle increases.

9. The bearing arrangement as in claim 1, wherein a bearing disk plane through said axes of said bearing disks forms an angle of about 10° with said common plane of said rotor shafts.

10. Bearing for a spinning rotor of one of at least two adjoining open-end spinning devices, whereby the spinning rotor is provided with a rotor shaft by means of which it can be driven by a tangential belt in a predetermined direction and is supported in a nip formed by at least two bearing disks mounted rotatably by a shaft and capable of being driven by the rotor shaft, of which at least one bearing disk which is leading relative to the drive directions of the tangential belt rotates into the nip while another bearing disk which is trailing relative to this drive direction rotates out of the nip, characterized in that the axis of the bearing disk rotating into the nip is at a distance from a plane which passes through the rotor shafts of the spinning rotors of adjoining open-end spinning devices, said distance being less than the distance between the axis of the supporting disk rotating out of the nip and the plane passing through the rotor shafts.

* * * * *